US006693398B2

(12) United States Patent
Cho

(10) Patent No.: US 6,693,398 B2
(45) Date of Patent: Feb. 17, 2004

(54) ELECTRON GUN FOR CRT

(75) Inventor: Sung Ho Cho, Daegu-si (KR)

(73) Assignee: LG. Philips Displays Korea Co., Ltd., Gyeongsangbuk-Do (KR)

( * ) Notice: Subject to any disclaimer, the term of this patent is extended or adjusted under 35 U.S.C. 154(b) by 0 days.

(21) Appl. No.: 10/244,398

(22) Filed: Sep. 17, 2002

(65) Prior Publication Data

US 2003/0214260 A1 Nov. 20, 2003

(30) Foreign Application Priority Data

May 14, 2002 (KR) ..... 2002-26498

(51) Int. Cl.[7] ..... G09G 1/28

(52) U.S. Cl. ..... 315/368.11; 315/382; 315/15; 315/17; 313/414; 313/449

(58) Field of Search ..... 315/14–17, 368.11, 315/368.15, 368.18, 371, 382, 382.1; 313/411–415, 421, 428, 446, 448, 449, 429

(56) References Cited

U.S. PATENT DOCUMENTS 5,212,423 A * 5/1993 Noguchi et al. ..... 313/414
5,455,481 A * 10/1995 Choi ..... 313/414
5,744,917 A * 4/1998 Kawaharada ..... 315/382.1
6,486,623 B2 * 11/2002 Van Vroonhoven ..... 315/382
6,541,903 B1 * 4/2003 Kagabu et al. ..... 313/421
6,597,096 B1 * 7/2003 Amano et al. ..... 313/414

OTHER PUBLICATIONS

Declaration of Michael Bowling, and Exhibit A (5 sheets) and Exhibit B (4 sheets).

* cited by examiner

*Primary Examiner*—Haissa Philogene
(74) *Attorney, Agent, or Firm*—Birch, Stewart, Kolasch & Birch, LLP

(57) ABSTRACT

The present invention relates generally to an electron gun for a color cathode ray tube, and more particularly to an electron gun for achieving an excellent focus characteristic on the whole screen by forming a dynamic quadruple lens in the electron gun used for a transpose scan type cathode ray tube. The present invention, in a transpose scan type cathode ray tube, an electron gun comprises a cathode electrode; a control electrode for controlling a generation amount of the electron beams; an acceleration electrode; a pre-focusing lens stage formed by pre-focusing electrodes; and a main lens stage having a main focusing electrode and an anode electrode, wherein the pre-focusing electrodes and the main focusing electrode are divided into at least two electrodes, and one of the divided two electrodes is applied by a constant voltage, and the other electrode is applied by a dynamic voltage, and quadruple lens stages are formed in the confronting portions between the electrode applied by the constant voltage and the electrode applied by the dynamic voltage.

6 Claims, 8 Drawing Sheets

ELECTRON GUN FOR CRT

BACKGROUND OF THE INVENTION

1. Field of the Invention

The present invention relates generally to an electron gun for a cathode ray tube, and more particularly to an electron gun for a cathode ray tube to achieve an excellent focus characteristic on the whole screen by forming a dynamic quadruple lens in the electron gun used for a transpose scan type cathode ray tube.

2. Description of the Related Art

FIG. 1 is a view of showing a structure of a general related cathode ray tube and electron gun, and FIG. 2 is a view of showing a structure of a general related electron gun.

As shown in FIG. 1 and FIG. 2, the general cathode ray tube (CRT) and an in-line type electron gun for the CRT includes three cathodes 3 that are independent from each other; a first electrode 4 that is separated from the cathode 3 at a specific interval; a second electrode 5, a third electrode 6 and a fourth electrode 7 that are positioned at regular intervals from the first electrode 4; a fifth electrode 8-1, 8-2, 8-3 that are divided into three electrodes; a sixth electrode 9; and a shield cup 10 to which a B.S.C 11 is attached at its upper part.

Additionally, a deflection yoke 12 that allows electron beams 13 to be deflected onto a whole screen 15 is mounted on an outside of the electron gun. The general cathode ray tube further includes a shadow mask 14, which is an electrode to distinguish colors, and a screen 15 having a fluorescent material.

An operation of the electron gun constructed as above is described as follows. The electrodes forming the electron gun are respectively provided with different voltages in order to obtain an uniform current and allow their cut off voltages to be same.

In detail, the sixth electrode 9 that is an anode is provided with a constant voltage Eb of about 26000V, and a first electrode 8-1, and a third electrode 8-3 of the fifth electrode and the third electrode 6 are provided with a dynamic voltage Vdf that varies simultaneously according to a deflection force of the deflection yoke 12.

Additionally, a second electrode 8-2 of the fifth electrode is applied by a focus voltage Vsf, and the second electrode 5 and the fourth electrode 7 are applied with a constant voltage Ec2 of about 600V. The first electrode 4 that is a control electrode is applied by a ground voltage.

As a heater 2 that is mounted in the cathode 3 of the electron gun is heated, electrons are emitted from a stem pin 1, and an amount of the emitted electrons are controlled by the first electrode 4. The controlled electron beams 13 is accelerated by the second electrode 5, and the accelerated electron beams 13 are partly converged by the third electrode 6, the fourth electrode 7 and the third electrode 8-3 of the fifth electrode. The converged electron beams 13 pass the third electrode 8-3 and the second electrode 8-2 of the fifth electrode that form a MQ lens for circularizing shapes of spots around the screen.

Additionally, the electron beams 13 pass the second electrode 8-2 and the first electrode 8-1 of the fifth electrode which form a dynamic quadruple DQ lens for eliminating a Halo phenomenon that occurs at the spots around the screen.

Additionally, the electron beams 13 pass the sixth electrode 9 and are deflected onto the whole screen 15 by the deflection yoke 12 mounted on the outside of the electron gun.

The deflected electron beams 13 pass a shadow mask 14, and collide with the screen having the fluorescent material to form a picture.

FIG. 3*a* and FIG. 3*b* are views of describing shapes of holes for passing the electron beams in the related electron gun.

With respect to FIG. 3*a*, in the related in-line type electron gun, a surface 27 of the third electrode 8-3 of the fifth electrode for forming the MQ lens, which is opposite to the second electrode 8-2, and a surface 29 of the second electrode 8-2 of the fifth electrode forming the dynamic quadruple lens, which is opposite to the first electrode 8-1, are provided a passage hole 18 for the electron beams having a longitudinal keyhole shape combining a circle and a rectangular having its width smaller than its length.

Additionally, a surface 28 of the second electrode 8-2 of the fifth electrode for forming the MQ lens, which is opposite to the third electrode 8-3, and a surface 30 of the first electrode 8-1 of the fifth electrode forming the dynamic quadruple lens, which is opposite to the second electrode 8-2, are provided a passage hole 19 for the electron beams having a transversal keyhole shape combining a circle and a rectangular having its width longer than its length.

FIG. 4 shows a scan configuration 16 on the screen of the related CRT and positions 17 of 3 color electron beams of the electron gun.

As shown in this figure, in the related CRT, the electron beams are shot on the screen from its upper part to its lower part and from the left to the right, and the 3 color electron beams of the electron gun are horizontally arranged in an in-line shape.

FIG. 5*a* and FIG. 5*b* are views of describing lenses of the electron gun.

In a related CRT, asymmetric lenses are arranged between the separated 3 electrodes of the fifth electrode, and the asymmetric lenses have intensities that are varied by the dynamic voltage synchronized by the deflection current.

A detail explanation of an operation of the asymmetric lenses is as follows.

The dynamic quadruple lens DQ formed between the first electrode 8-1 and the second electrode 8-2 of the fifth electrode performs an asymmetric operation in the largest at comers of the screen where the deflection current is highest, that is, where the deflection force of the deflection yoke 12 is largest.

On the other hand, the lens performs a smallest asymmetric operation at a center of the screen where there is little deflection current, that is, where there is little deflection force.

In the related in-line type electron guns without the dynamic quadruple lens, a horizontal spotting magnification and a vertical spotting over-convergence occur around the screen because of an non-uniform magnetic field DL of a self-convergence deflection yoke, thus causing a Halo phenomenon and focus deterioration around the screen.

This phenomenon means that a horizontal convergence force for the electron beams is weakened by the non-uniform magnetic field for the deflection and a vertical convergence force for the electron beams is intensified. A dynamic lens for overcoming the problem as above weakens the vertical convergence force around the screen to achieve an excellent focus characteristic over the whole screen as shown in FIG. 5*a*.

Additionally, a dynamic voltage is applied to the first electrode 8-1 of the fifth electrode to change, according to the deflection, an intensity of the main lens ML that performs the most important action for the convergence of the electron beams, thus compensating a focus distance, which increases in the case of the deflection of the electron beams around the screen, by weakening the intensity of the main lens.

As shown in FIG. 5*b*, the MQ lens formed between the second electrode 8-2 and the third electrode 8-3 of the fifth electrode allows the horizontal convergence force to be weaken according to an increase of the deflection force, unlike the dynamic quadruple lens.

On the other hand, as shown in 23 of the FIG. 6*b*, the MQ lens has an action to intensify the convergence force to compensate a longitudinal extension phenomenon 20 of spots around the screen in the case of having only the dynamic quadruple lens DQ as shown in 20 of FIG. 6*a*

Meanwhile, a spot diameter can be calculated by a multiplication of a object space size and a lens magnification, which is determined by a start angle (θo) of an electron beam and an incidence angel (θi) of the electron beam, as shown in a following formula The spot diameter is inversely proportional to the incidence angle (θ i) of the electron beam on the screen in case the start angles (θ o) of the electron beams are same.

$$M=(\theta o/\theta i)\times(Vo/Vi)^{1/2}$$

The dynamic quadruple lens DQ increases an angle difference between a horizontal incidence angle and a vertical incidence angle of the electron beams that pass all electrostatic lenses (θ ix<<θ iy), causing a transversal extension 20 of the spot at edges of the screen.

Accordingly, a horizontal convergence angle and a vertical convergence angle are similarly compensated by forming the MQ lens having a reverse action in front of the dynamic quadruple lens DQ as shown in FIG. 5*b* (θ ix≈θ iy), thus obtaining a spot 23 which is nearly a circle at an edge of the screen.

In this case, at a top and a bottom of the screen, a longitudinal spot 22 is formed which is the spot extension by a MQ lens plus with the spot extension 21 by the vertical deflection magnetic field without the MQ lens, and the longitudinal spot does not cause a problem in the focus characteristic because the vertical spot is small in comparison with the horizontal spot.

However, in the related cathode ray tube, the incidence is performed in a horizontal direction as shown in FIG. 4 and a horizontal length of the screen is larger than its vertical length, thus increasing an Halo amount of the spots resulting from the deflection magnetic field (substantially pincushion-shaped deflection field) in a horizontal direction of the deflection yoke. In order to compensate the Halo occurred as above, the electron gun increases the intensity of the dynamic quadruple lens to increase the dynamic voltage at the same time, and so cathode ray tubes for a monitor has a difficulty in increasing the deflection angle of the deflection yoke above 100°.

Accordingly, in order to solve the problem due to the electron beam incidence in the horizontal direction, a technique for a Transpose Scan (TPS) has been developed which rotates the deflection yoke which rotates the deflection yoke and the electron gun of the related CRT by 90°.

However, in the TPS cathode ray tube, its vertical length is larger than its horizontal length with the in-line direction of the electron gun as the reference direction and so the upper and the lower of the screen is larger that its edge part in case of using the related electron gun. Thus, the longitudinal extension of the spot increases considerably to largely increase horizontal spots 24 at the edges of the screen as shown in FIG. 7*b*, thus causing a problem that the focus characteristics deteriorates.

SUMMARY OF THE INVENTION

Accordingly, the present invention has been made keeping in mind the above problems occurring in the prior art, and an object of the present invention is to provide an electron gun for a color cathode ray tube for achieving an excellent focus characteristic on the whole screen by forming a dynamic quadruple lens in the electron gun used for a transpose scan type cathode ray tube.

To achieve the above object, there is provided an electron gun for a cathode ray tube, which is a transpose scan type cathode ray tube including an electron gun having three cathodes arranged vertically in line to generate three color (R.G.B) electron beams, and a deflection yoke having a coil for generating a substantially pincushion-shaped deflection field for deflecting the electron beams generated from the electron gun toward a short axis direction of the screen and a coil for generating a substantially barrel-shaped deflection field for deflecting the electron beams generated from the electron gun toward a long axis direction of the screen, the electron gun comprising: a cathode electrode; a control electrode for controlling a generation amount of the electron beams; an acceleration electrode; a pre-focusing lens stage formed by pre-focusing electrodes; and a main lens stage having a main focusing electrode and an anode electrode, wherein the pre-focusing electrodes and the main focusing electrode are divided into at least two electrodes, and one of the divided two electrodes is applied by a constant voltage, and the other electrode is applied by a dynamic voltage, and quadruple lens stages are formed in the confronting portions between the electrode applied by the constant voltage and the electrode applied by the dynamic voltage.

The present invention can make the transversally extended spot, in the edges of the screen, into almost an circle, thus obtaining an excellent focus characteristic on the whole screen.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, an embodiment of the present invention is described with respect to accompanying drawings.

The present invention is an electron gun for a CRT, the CRT of the transpose scan type including an electron gun having 3 cathodes arranged vertically in line to generate 3 color (R.G.B) electron beams, and a deflection yoke having a coil for generating a substantially pincushion-shaped deflection field for deflecting the electron beams generated from the electron gun toward a short axis direction of the screen and a coil for generating a substantially barrel-shaped deflection field for deflecting the electron beams generated from the electron gun toward a long axis direction of the screen. Here, shapes of passage holes for the electron beams of electrodes forming a MQ lens of the electron gun are changed, thus decreasing a size of a screen which affects a horizontal deflection magnetic field of the deflection yoke and increasing the deflection force to obtain a cathode ray tube for a monitor having the deflection angle above 100°.

Figure 1:
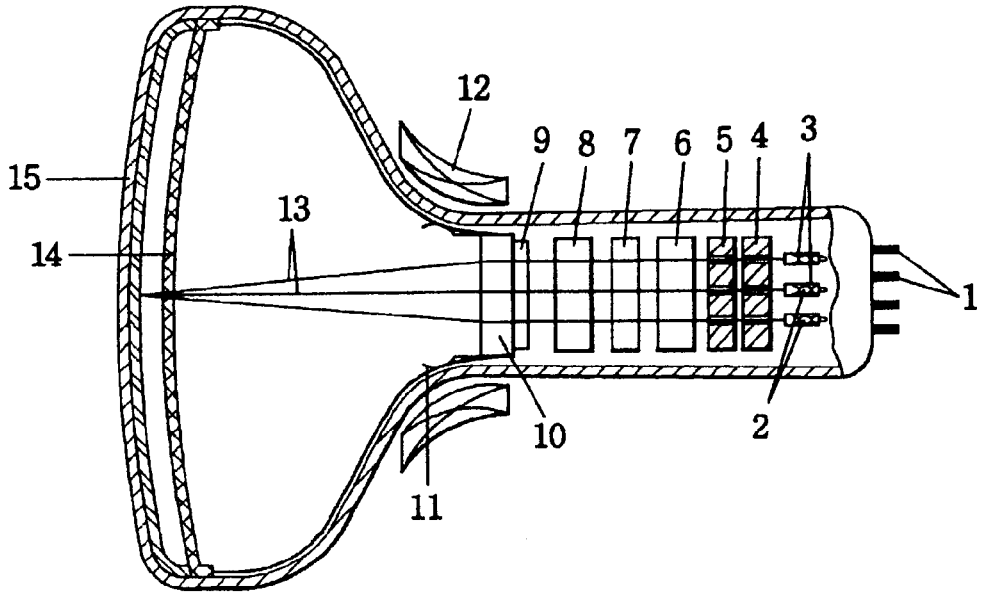
Fig. 1 (Related art)
FIG. 1 is a structural view of a general cathode ray tube and an electron gun.
Figure 2:
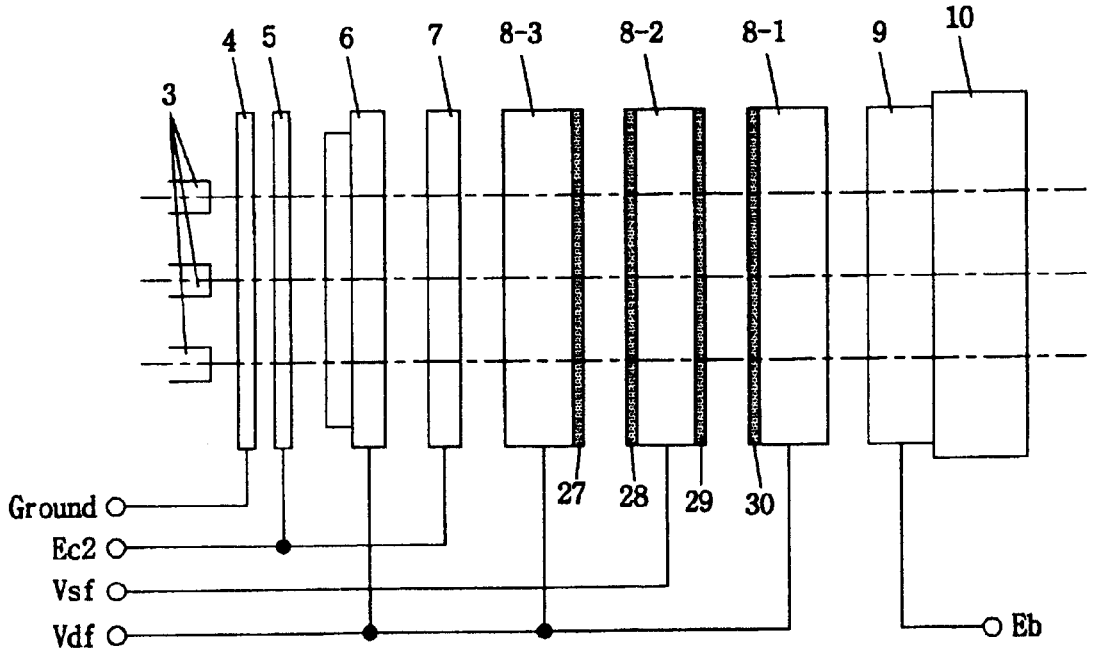
Fig. 2 (Related art)
FIG. 2 is a structural view of a general electron gun.
Figure 3A:
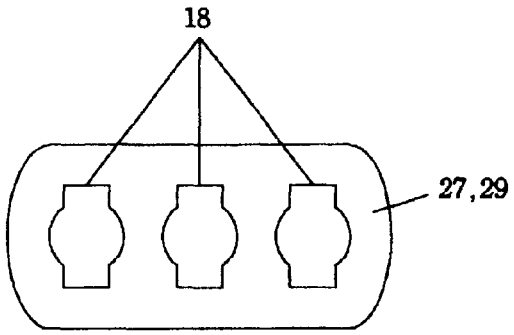
Fig. 3a (Related art)
FIG. 3*a* is a view of showing a shape of a passage hole for the electron beams of the related electron gun.
Figure 3B:
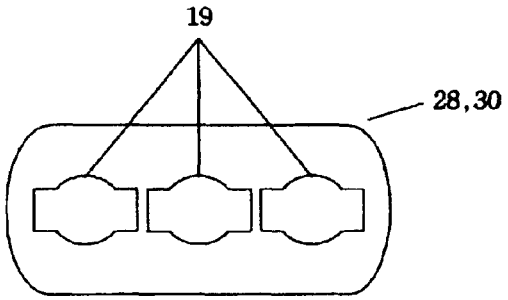
Fig. 3b (Related art)
FIG. 3*b* is a view of showing a shape of a passage hole for the electron beams of the related electron gun.
Figure 4:
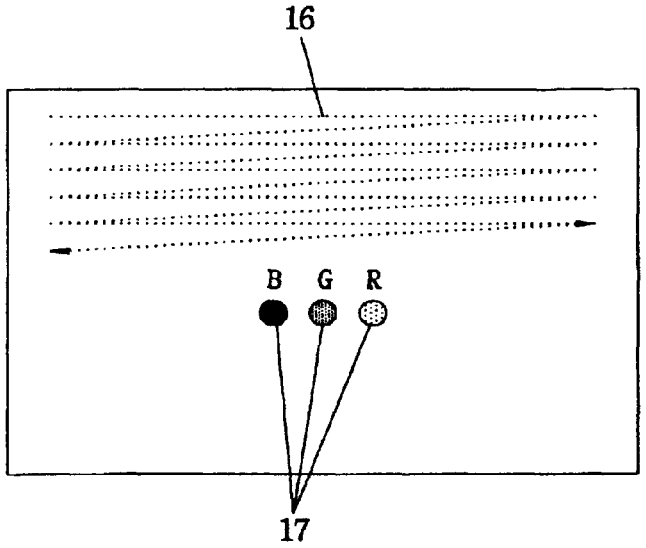
Fig. 4 (Related art)
FIG. 4 is a view of showing a scan direction and an arrangement of the electron gun in the related CRT.
Figure 5A:
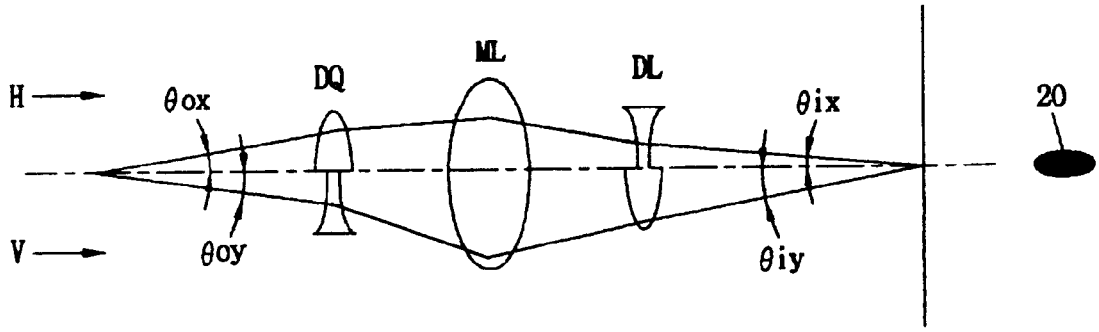
Fig. 5a (Related art)
FIG. 5*a* and FIG. 5*b* are views of showing patterns of lenses in the related electron gun.
Figure 5B:
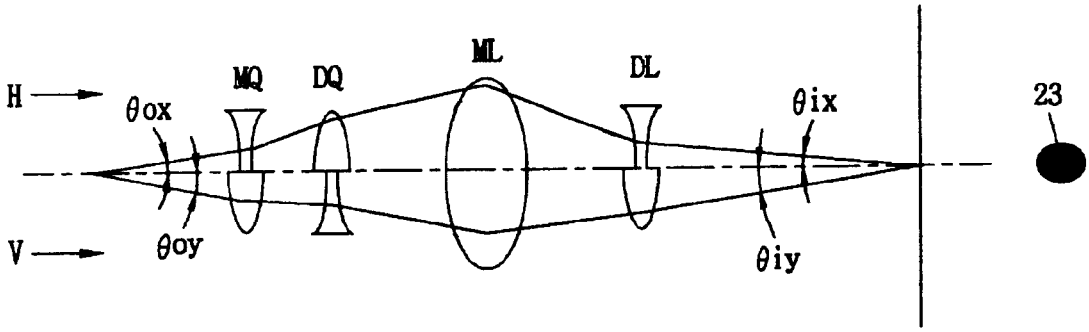
Fig. 5b (Related art)
Figure 6A:
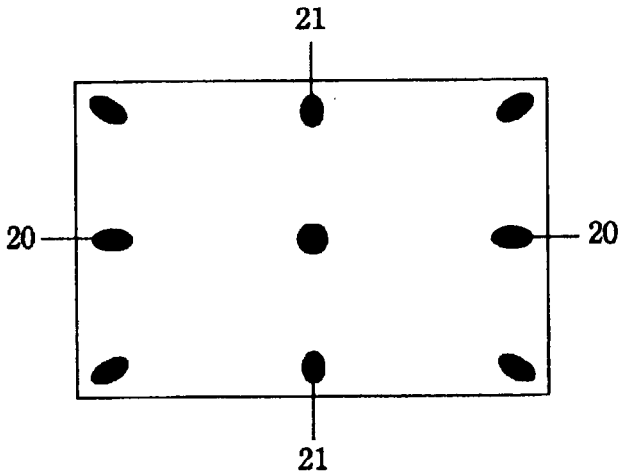
Fig. 6a (Related art)
FIG. 6*a* and FIG. 6*b* are views of showing spot shapes on the screen in the related CRT.
Figure 6B:
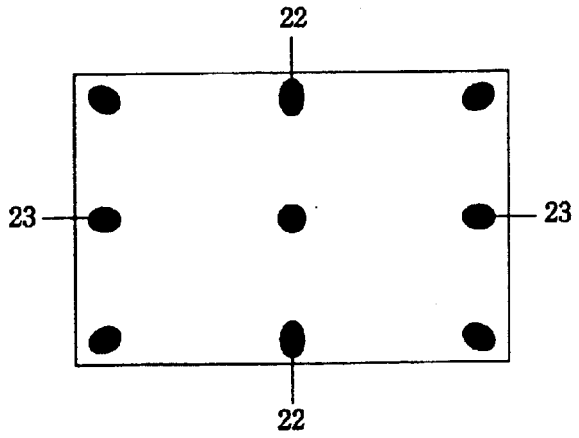
Fig. 6b (Related art)
Figure 7A:
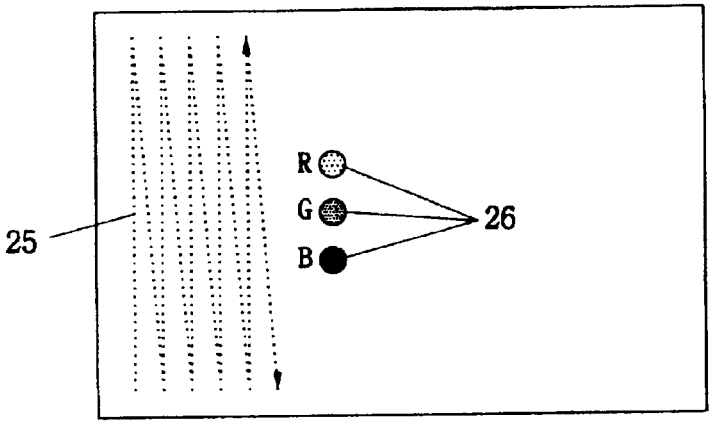
Fig. 7a (Related art)
FIG. 7*a* is a view of showing a scan direction and an arrangement of the electron gun in the transpose scan type CRT.
Figure 7B:
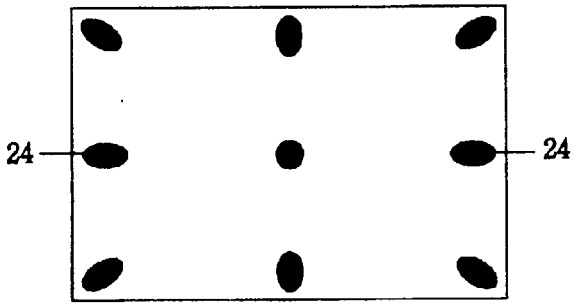
Fig. 7b (Related art)
FIG. 7*b* is a view of showing spot shapes on the screen in the related transpose scan type CRT.
Figure 8:
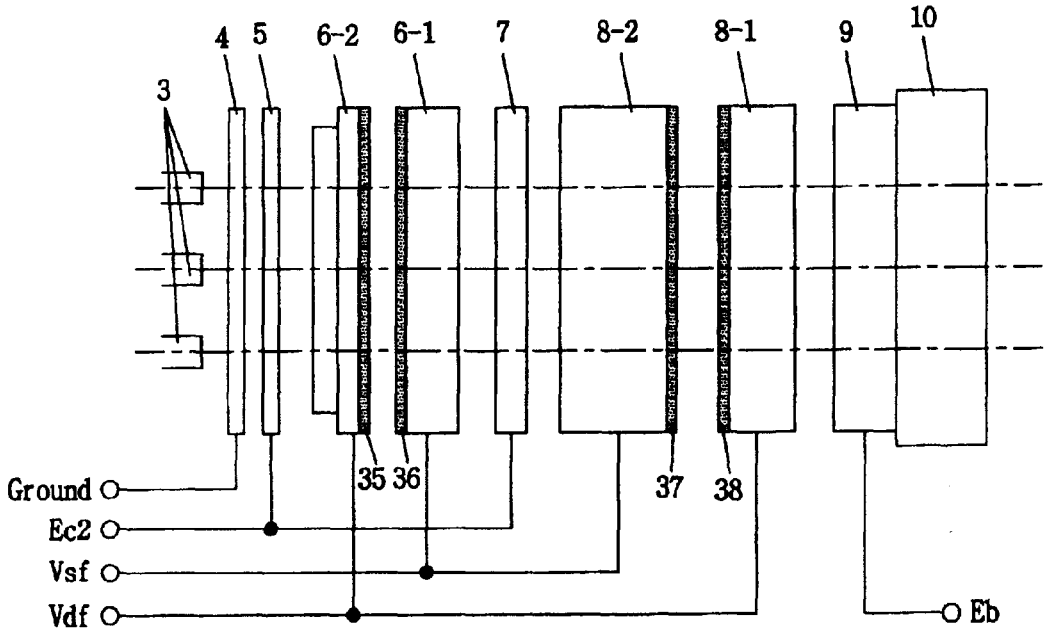
FIG. 8 is a view of showing the first embodiment of the present invention.
Figure 9A:
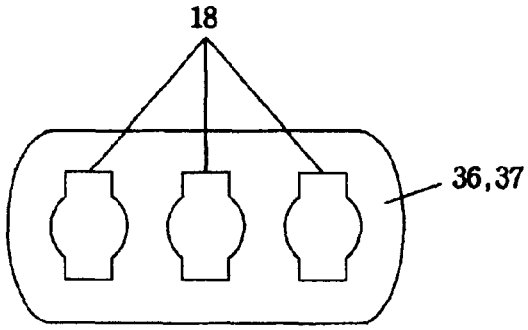
FIG. 9*a* and FIG. 9*b* are views of showing shapes of the passage holes for the electron beams in the first embodiment.
Figure 9B:
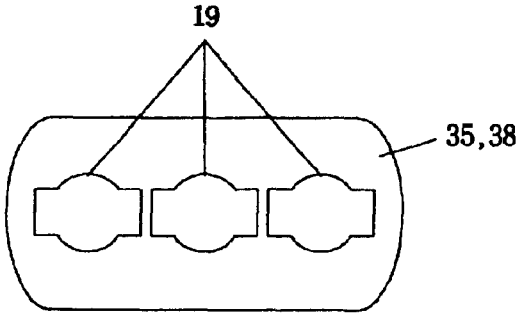

FIG. 8 is an embodiment of the present invention, and FIG. 9*a* and FIG. 9*b* are views of showing the passage holes for the electron beams.

With respect to FIG. 8, and FIG. 9*a* and FIG. 9*b*, the third electrode is divided into two electrodes 6-1, 6-2. A surface 36 of the first electrode 6-1 of the third electrode, which is opposite to the second electrode 6-2, is provided with a longitudinal passage hole 18 for the electron beams as shown in FIG. 9*a* Additionally, a surface 35 of the second electrode 6-2 of the third electrode, which is opposite to the first electrode 6-1, is provided with a transversal keyhole shape passage hole 19 for the electron beams as shown in FIG. 9*b*.

The first electrode 6-1 of the third electrode is applied with a regular focus voltage Vsf, and the second electrode 6-2 of the third electrode is applied by a dynamic voltage Vdf.

Additionally, the fifth electrode is divided into two electrodes 8-1, 8-2, and these two electrodes are formed in the same way as in the related electron gun. That is, a surface 37 of the second electrode 8-2 of the fifth electrode that is opposite to the first electrode 8-1 is formed with a longitudinal keyhole shape passage hole 18 for the electron beams as shown in FIG. 9*a*, and a surface 38 of the first electrode 8-1 of the fifth electrode that is opposite to the second electrode 8-2 is formed with a transversal keyhole shape passage hole 19 for the electron beams as shown in FIG. 9*b*.

Figure 10:
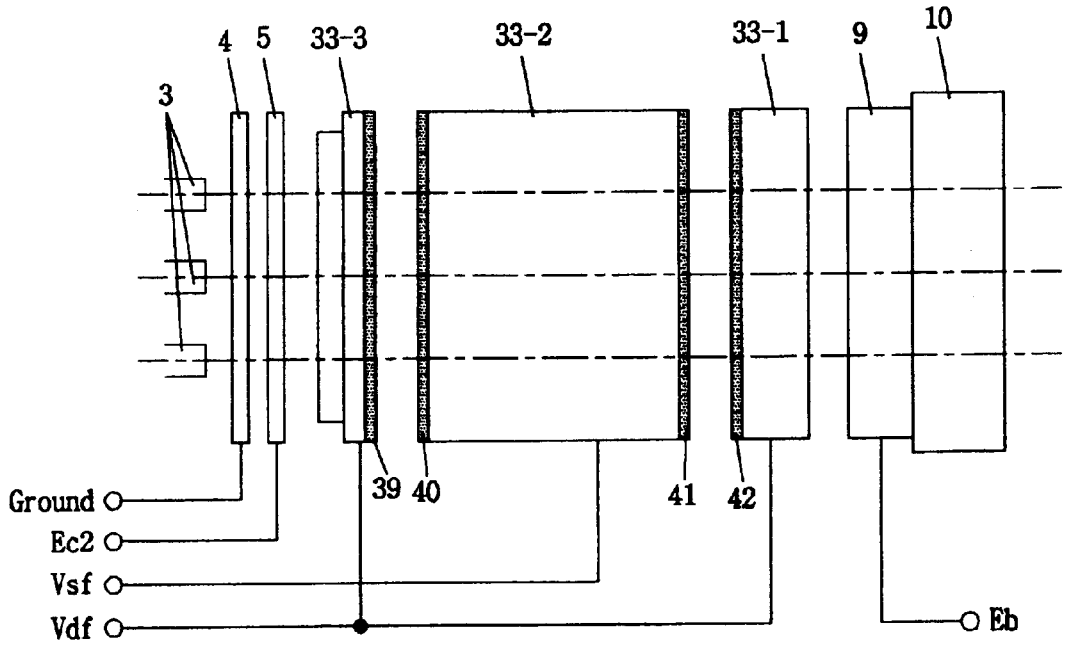
FIG. 10 is a view of showing the second embodiment of the present invention.
Figure 11A:
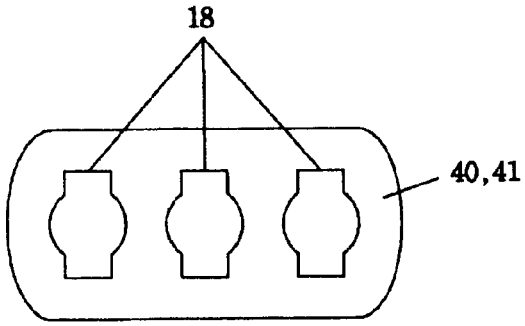
FIG. 11*a* and FIG. 11*b* are views of showing shapes of the passage holes for the electron beams in the second embodiment.
Figure 11B:
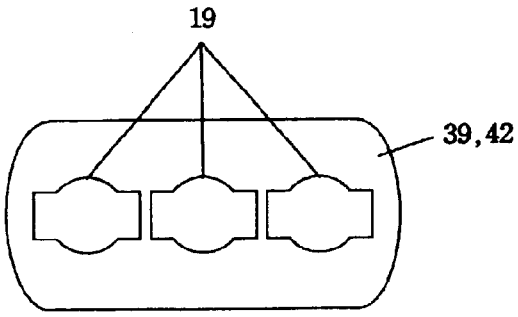

FIG. 10 is a second embodiment of the present invention, and FIG. 11*a* and FIG. 11*b* are views of showing the passage holes for the electron beams. With respect to FIG. 10, the number of the electrodes of the electron beam is reduced to decrease its fabrication cost.

That is, the pre-focusing lenses, which is formed between the third electrode and the fourth electrode and the third electrode of the fifth electrode, are removed, and the third electrode is divided into three electrodes (33-1,33-2,33-3).

A surface 40 of the second electrode 33-2 of the third electrode, which is opposite to the third electrode 33-3, and a surface 41 of the second electrode 33-2 that is opposite to the first electrode 33-1 are formed with a longitudinal keyhole shape passage hole 18 for the electron beams of FIG. 11*a*.

Additionally, a surface 39 of the third electrode 33-3 of the third electrode, which is opposite to the second electrode 33-2, and a surface 42 of the first electrode 33-1 that is opposite to the second electrode 33-2 are formed with a tnansversal keyhole shape passage hole 19 for the electron beams of FIG. 11*b*.

Additionally, the first electrode 33-1 and the third electrode 33-3 of the third electrode are applied by the dynamic voltage Vdf, and the second electrode 33-2 is applied by the regular focus voltage Vsf.

Figure 12:
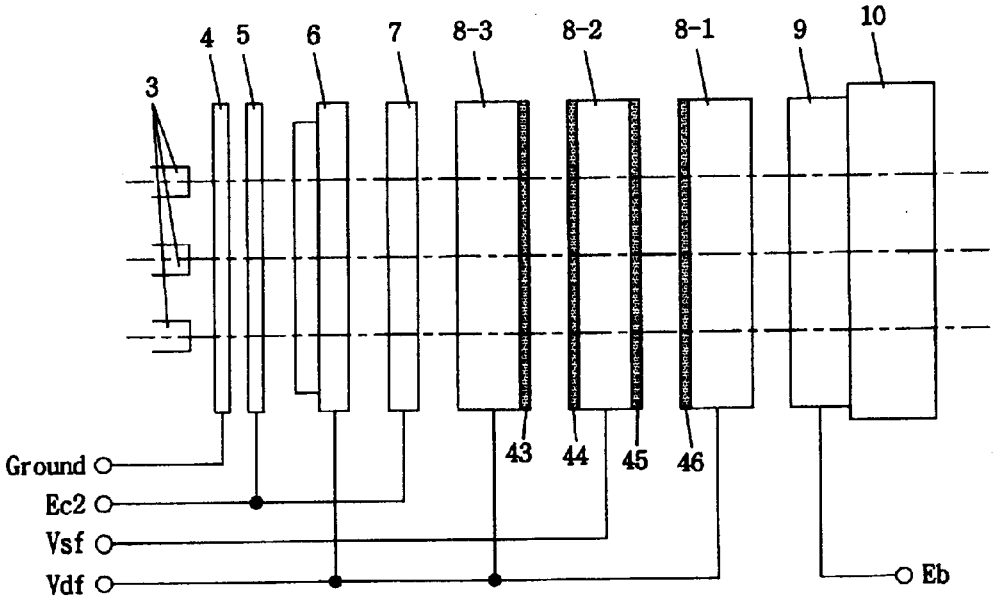
FIG. 12 is a view of showing the third embodiment of the present invention.
Figure 13A:
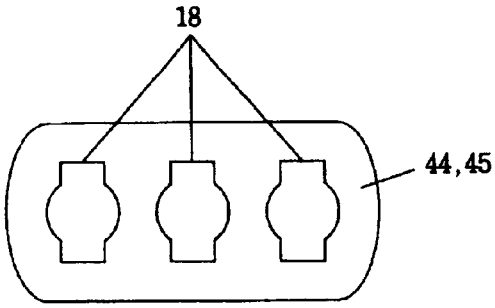
FIG. 13*a* and FIG. 13*b* are views of showing shapes of the passage holes for the electron beams in the third embodiment.
Figure 13B:
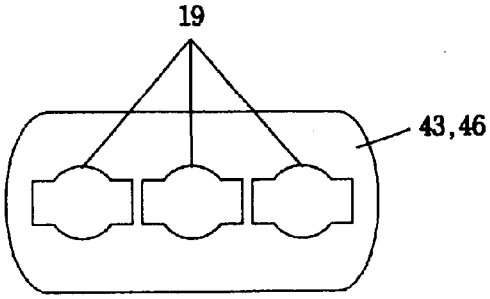
Figure 14:
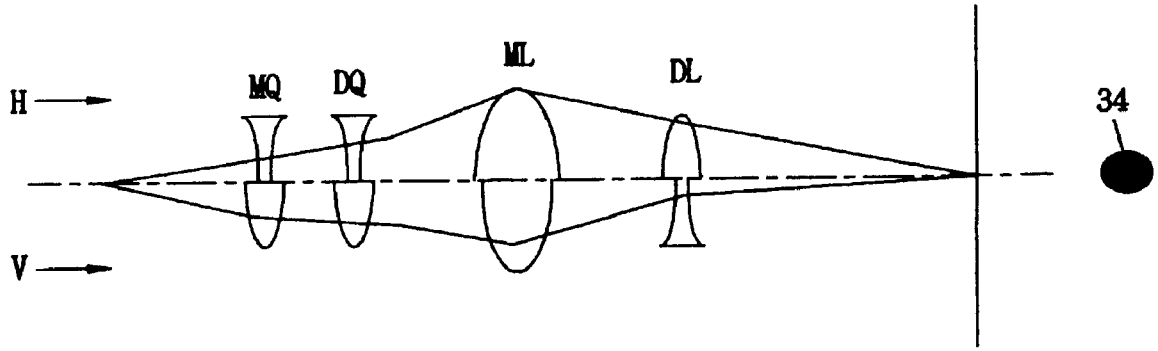
FIG. 14 is a view of showing a pattern of lenses in the electron gun of the present invention.

FIG. 12 is a third embodiment of the present invention, and FIG. 13*a* and FIG. 13*b* are views of showing the passage holes for the electron beams.

With respect to, FIG. 12, FIG. 13*a* and FIG. 13*b*, this embodiment of the present invention has a similar construction to the related electron gun, and however the shape of the passage hole for the electron beams between the third electrode 8-3 and the second electrode 8-2 of the fifth electrode is changed.

That is, a surface 44 of the second electrode of the fifth electrode, which is opposite to the third electrode, is formed with the longitudinal passage hole 18 of the FIG. 13*a*.

Additionally, a surface 43 of the third electrode of the fifth electrode, which is opposite to the second electrode, is formed with the transversal keyhole shape passage hole 19 of the FIG. 13*b*.

A voltage wire and the passage holes of the other electrodes except the above holes are same as in the related electron gun.

In the CRT employing the electron gun constructed as above, observing the gun with a horizontal/vertical direction of the screen as a reference, the electron beams are converged in a vertical direction (the in-line direction of the electron gun) by the MQ lens formed in the first electrode 6-1 and the second electrode 6-2 of the third electrode of FIG. 8, the second electrode 33-2 and the third electrode 33-3 of the third electrode of FIG. 10, and the second electrode 8-2, and the third electrode 8-3 of the fifth electrode of FIG. 12 when the electron beams are deflected to the edges of the screen. Thus, the horizontal incidence angle of the electron beams on the screen is larger than the vertical one ($\theta ix > \theta iy$) to obtain longitudinal spots on the screen. This longitudinal extension is offset by the transversal phenomenon of the spots resulting from the vertical deflection magnetic field as the related electron gun, thus obtaining spots 34 similar to a circle at the edges of the screen.

Figure 15:
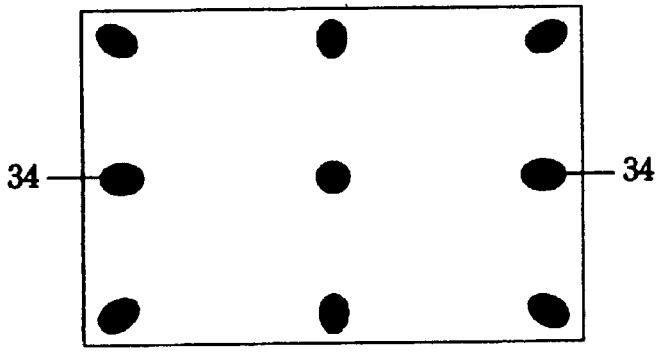
FIG. 15 is a view of showing spot shapes on the screen in the CRT employing the electron gun of the present invention.

Accordingly, an excellent focus characteristic can be achieved on the whole screen in FIG. 15. The present invention compensates, in the transpose scan type CRT that reduces a volume of the CRT by increasing the deflection force, the transversally extended spots to have nearly circle shapes at the edges of the screen, thus achieving the excellent focus characteristic on the whole screen.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An electron gun for a cathode ray tube, which is a transpose scan type cathode ray tube including an electron gun having three cathodes arranged vertically in line to generate three color (R.G.B) electron beams, and a deflection yoke having a coil for generating a substantially pincushion-shaped deflection field for deflecting the electron beams generated from the electron gun toward a short axis direction of the screen and a coil for generating a substantially barrel-shaped deflection field for deflecting the electron beams generated from the electron gun toward a long axis direction of the screen, the electron gun comprising:

a cathode electrode;

a control electrode for controlling a generation amount of the electron beams;

an acceleration electrode;

a pre-focusing lens stage formed by pre-focusing electrodes; and a main lens stage having a main focusing electrode and an anode electrode, wherein the pre-focusing electrodes and the main focusing electrode are divided into at least two electrodes, and one of the divided two electrodes is applied by a constant voltage, and the other electrode is applied by a dynamic voltage, and quadruple lens stages are formed in the confronting portions between the electrode applied by the constant voltage and the electrode applied by the dynamic voltage.

2. The electron gun according to claim 1, wherein the electrode, which is applied with the dynamic voltage among the electrodes forming the quadruple lens stages, is formed with a passage hole for the electron beams having a keyhole shape combining a circle and a rectangular having a longer width than its length, while the electrode, which is applied with the constant voltage among the electrodes forming the quadruple lens stages, is formed with a passage hole for the electron beams having a keyhole shape combining a circle and a rectangular having a longer length than its width.

3. An electron gun for a cathode ray tube, which is a transpose scan type cathode ray tube including an electron gun having three cathodes arranged vertically in line to generate three color (R.G.B) electron beams, and a deflection yoke having a coil for generating a substantially pincushion-shaped deflection field for deflecting the electron beams generated from the electron gun toward a short axis direction of the screen and a coil for generating a substantially barrel-shaped deflection field for deflecting the electron beams generated from the electron gun toward a long axis direction of the screen, the electron gun comprising:

a cathode electrode;

a control electrode for controlling a generation amount of the electron beams, an acceleration electrode; and a main lens stage having a main focusing electrode and an anode electrode, wherein the main focusing electrode is divided into at least three electrodes, and at least two electrodes of the divided three electrodes are respectively applied by a dynamic voltage, and the other electrode is applied by a constant voltage, and quadruple lens stages are formed in the confronting portions between the electrode applied by the constant voltage and the electrode applied by the dynamic voltage.

4. The electron gun according to claim 3, wherein the electrode, which is applied with the dynamic voltage among the electrodes forming the quadruple lens stages, is formed with a passage hole for the electron beams having a keyhole shape combining a circle and a rectangular having a longer width than its length, while the electrode, which is applied with the constant voltage among the electrodes forming the quadruple lens stages, is formed with a passage hole for the electron beams having a keyhole shape combining a circle and a rectangular having a longer length than its width.

5. An electron gun for a cathode ray tube, which is a transpose scan type cathode ray tube including an electron gun having three cathodes arranged vertically in line to generate three color (R.G.B) electron beams, and a deflection yoke having a coil for generating a substantially pincushion-shaped deflection field for deflecting the electron beams generated from the electron gun toward a short axis direction of the screen and a coil for generating a substantially barrel-shaped deflection field for deflecting the electron beams generated from the electron gun toward a long axis direction of the screen, the electron gun comprising:

a cathode electrode;

a control electrode for controlling a generation amount of the electron beams;

an acceleration electrode;

a pre-focusing lens stage formed by pre-focusing electrodes; and a main lens stage having a main focusing electrode and an anode electrode;

wherein the main focusing electrode is divided into at least three electrodes, and at least two electrodes of the divided three electrodes are respectively applied by a dynamic voltage, and the other electrode is applied by a constant voltage, and quadruple lens stages are formed in the confronting portions between the electrode applied by the constant voltage and the electrode applied by the dynamic voltage.

6. The electron gun according to claim 5, wherein the electrode, which is applied with the dynamic voltage among the electrodes forming the quadruple lens stages, is formed with a passage hole for the electron beams having a keyhole shape combining a circle and a rectangular having a longer width than its length, while the electrode, which is applied with the constant voltage among the electrodes forming the quadruple lens stages, is formed with a passage hole for the electron beams having a keyhole shape combining a circle and a rectangular having a longer length than its width.

* * * * *